United States Patent [19]

Coslovi et al.

[11] Patent Number: 4,854,136

[45] Date of Patent: Aug. 8, 1989

[54] TEXTILE MANUFACTURED ARTICLE FOR CONTACT FASTENER

[75] Inventors: Giuliano Coslovi, Brugherio; Italo Casalegno, Merate, both of Italy

[73] Assignee: Ausonia S.p.A., Milan, Italy

[21] Appl. No.: 148,647

[22] Filed: Jan. 26, 1988

[30] Foreign Application Priority Data

Jan. 30, 1987 [IT] Italy ..... 19220 A/87

[51] Int. Cl.[4] ..... D04B 7/12

[52] U.S. Cl. ..... 66/191

[58] Field of Search ..... 66/191

[56] References Cited

U.S. PATENT DOCUMENTS

| | | | |
|---|---|---|---|
| 30,638 | 6/1981 | Bryars | 66/191 |
| 709,840 | 9/1902 | Williams | 66/191 |
| 2,331,289 | 9/1943 | Amidon | 66/191 |
| 2,400,524 | 5/1946 | Amidon | 66/191 |

*Primary Examiner*—James J. Bell
*Attorney, Agent, or Firm*—Robbins & Laramie

[57] ABSTRACT

In a manufactured article for contact fastener constituted by a textile support, from one side of which hooking elements protrude, for the purpose of anchoring such elements to the textile support, without having to resort to a sizing, the same support is formed by warp chains tied by at least one weft, and the effect yarn lengths constituting the hooking elements, which are interlaced with the warp chains, are blocked by heat-shrunk stitches of said chains. In order to obtain such result, the yarns forming the warp chains are constituted by a raw material having a coefficient of heat shrinking which is considerably larger that that of the weft yarn tying the warp chains.

Also a method and an equipment for accomplishing such a textile manufactured article are provided.

7 Claims, 3 Drawing Sheets

TEXTILE MANUFACTURED ARTICLE FOR CONTACT FASTENER

BACKGROUND OF THE INVENTION

The present invention relates to a textile manufactured article for contact fastener, as well as to a method and to an equipment for manufacturing it.

The so-said contact fasteners, which comprise a hooking part and a hooked part, commonly denominated as the "male" part and, respectively, the "female" part, are known. Both these parts of a contact closure are constituted by textile manufactured articles, one of which is formed by a textile support provided with peduncles protruding from one side of the support, and which may have different shapes, e.g., a mushroom shape, a hook shape, a harpoon shape, or the like, and the other one if formed by a textile support provided with slots protruding from one side of the support. The peduncles of the "male" manufactured article are generally constituted by monofilaments of a thermoplastic material, and the slots of the "female" manufactured article are constituted by multifilaments. Both these textile products are normally manufactured on looms, in particular on ribbon looms, and are formed by textile interlacements of warp yarns with weft yarns.

In the use of these contact fasteners, a "male" manufactured article is superimpsed upon a "female" manufactured article, and the peduncles of the "male" manufactured article are caused to get hooked with the slots of the "female" manufactured article by compression. In order to open the contact fastener, it is necessary to disengage the peduncles of the "male" manufactured article from the slots of the "female" manufactured article, and during this step the peduncles and the slots undergo a strong pull action, which tends to make them come out from their respective textile supports.

In order to prevent this coming out, the textile manufactured articles which constitute these contact fasteners are usually submitted to a special and momentous operation of glueing or sizing, during which the textile manufactured articles are coated with resins of various natures which, by crosslinking due to the action of heat, generate on, and inside, the textile support, a continuous film which binds and fixes the peduncles, and, respectively, the slots, to the textile support, by means of a chemical bond. Such sizing, besides this function, serves to also give the textile manufactured article a certain hand, as demanded by the market, i.e., a certain greater consistency.

The sizing which must be carried out in an operative step following, and distinct from, the production of the textile manufactured article on the loom, causes a productive complication with additional costs, and it is clear that if such a step could be avoided, a considerable reduction in total product cost would be achieved.

On the other side, it is also well-known that all the plastics films obtained from a process of crosslinking of polymers, and/or by means of other methods, are subject to aging, due to a depolymerization caused by oxidation processes induced by environmental agents, and by U.V. light. Furthermore, in the instant case, such films are also prone to breakages in their continuity, because of mechanical stresses, in particular owing to the mechanical stresses which are due to the strong tear action for the contact fasteners are subjected to during their usage, as well as to peeling off due to the washes with soap and/or solvents.

Therefore, a main purpose of the present invention is to provide a textile manufactured article for contact fastener, wherein such drawbacks are overcome, in particular a "male" manufactured article, but, possibly, also a "female" manufactured article, wherein the hooking elements, and respectively the hooked elements are sufficiently linked and bonded to the respective textile support, without any sizing being provided.

A further purpose of the invention is to propose a method and an equipment for the realization of such a sizing-free textile manufactured article, in particular of a "male" manufactured article for contact fastener.

SUMMARY OF THE INVENTION

In order to achieve the intended purposes, the present invention provides a textile manufactured article for contact fastener, which is formed by a textile support with an interwoven effect yarn, which constitutes hooking elements protruding from one side of the same support, said textile manufactured article being characterized in that its support is formed by warp yarns interlaced in such a way as to form warp chains linked by at least a first weft yarn, wherein each triplet of warp chains defines, from time to time, two side-by-side couples or pairs of warp chains sharing the central warp chain of the triplet, between the two warp chains of each couple of warp chains, a relevant corresponding effect yarn being interlaced in a meander path configuration, said effect yarn, constituting said hooking elements, being tied with, and blocked by sequences of at least two, and anyway of an even number of consecutive shrunk stitches alternatively belonging to the one, and to the other, of the warp chains of the couple of warp chains in correspondence of their points of tying with said weft yarn, the meandering path of the effect yarn with respect to a couple of warp chains being staggered in the direction of the warp relatively to the path of the effect yarn with respect to the side-by-side couple of warp chains by a value equal to the pitch of the same meandering path, and the yarns forming the warp chains and the effect yarns being constituted by raw materials having a coefficient of thermal shrinking which is considerably larger than that of the raw material constituting said weft yarn.

Possibly, in order to form a continuous textile support, in case the warp chains are not sufficiently close to each other, between these warp chains filling warp yarns can be inserted, and a second upper weft yarn can be provided, in order to tie, together with the first lower weft yarn, said filling yarns with one another. In this case, also the filling yarns are advantageously constituted by a raw material having a thermal shrinking coefficient larger than that of the raw material constituting the weft yarns.

In particular, the manufactured article according to the present invention is destined to constitute the "male" portion, i.e., the hooking portion of the contact fastener, and hence the various effect yarns interwoven according to a prescribed meandering path configuration between the couples of warp chains, in as much as have to form protruding peduncles, shall be constituted by monofilaments, e.g., of polypropylene, if the peduncles have a mushroom shape, or of polyamide if the peduncles have a hook shape.

The warp yarns, interlaced to form the chains, as well as the filling warp yarns may also be made from polypropylene, whilst the weft yarns may be of a polyester yarn.

In fact, the thermal shrinking coefficient of polypropylene, as well as of polyamide, is known to be considerably larger than that of polyester resins.

Thanks to the difference in the dimensional behaviour under the action of heat, of the raw materials used to form the yarns constituting the warp chains relative to the dimensional behaviour of the raw materials used to form the weft yarn(s), the result obtained is that the stitches of the warp chains, by shrinking to a larger extent under the action of heat, block in a very firm way the lengths of the effect yarns interlaced with them in their points of typing with the weft yarn, thus rendering superfluous any bonding and anchoring sizing.

In order to obtain a textile manufactured article for contact fastener which, resorting to a spreading of chemical character being necessary, already has an sufficient "intrinsic" consistency, i.e., a strong enough hand, using a polyester monofilament as the lower weft yarn, is suitable.

A method for realizing the textile manufactured article for contact fastener consists, according to the invention, of the steps of forming on a knitting machine, and in particular on a machine (commonly denominated a "crochet" machine) for warp knit fabric manufacturing, a textile support constituted by warp chains and at least a weft yarn, for the yarns destined to form the warp chains a raw material being used, which has a thermal shrinking coefficient which is considerably larger than of the raw material used for the weft yarn; of interlacing in said textile support effect yarns which are constituted by a raw material also having a thermal shrinking coefficient larger than of the raw material which constitutes the weft yarn, with the interlacing of the effect yarns in the textile support being carried out in such a way that each of effect yarn is interlaced in a meander path configuration between two warp chains forming a couples or pairs of warp chains, wherein each triplet of warp chains defines, from time to time, two side-by-side couples of warp chains sharing the central warp chain of the triplet, with the relevant effect yarn being tied by sequences of at least two, and anyway of an even number of consecutive stitches alternatively belonging to the one, and to the other, of the warp chains of the couple of warp chains in correspondence of their points of typing with said weft yarn; and forming, along the lengths of the effect yarn between the two relevant warp chains and oriented in the weft direction, slots protrucing from one side of the textile support, wherein the meander of the effect yarn relevant to a couple of warp chains is staggered in the direction of the warp relative to the meander of the effect yarn relevant to the side-by-side couple of warp chains by a value equal to the pitch of the same meander in other words, each of the effect yarns extending along the prescribed path travel a substantially similar distance in the warp direction prior to alternating between the corresponding warp chain triplet pairs; and submitting the so-formed textile manufactured article, immediately downstream the formation of the slots along the lengths of effect yarns oriented in the weft direction, to the action of heat, in order to cause the thermal shrinking of the stitches of the warp chains and of the effect yarns to take place.

The equipment provided according to the present invention for practicing said method of production of the textile manufactured article for contact fastener substantially comprises a knitting machine capable of forming a textile support with warp chains, equipped with means for inserting at least one weft, and with means for feeding and interweaving effect yarns between couples of warp chains, between the needles forming said warp chains stationary blades being positioned, which extend in the direction of the warp on planes perpendicular to the plane of the textile support being formed, and initially having a constant height, and then a height decreasing towards their free end, as well as heating means provided, which extend throughout the width of the textile manufactured article and in the direction of the warp substantially through the whole length of the blades along which they have a decreasing height.

The above-said blades, around which the effect yarns run along their lengths between the two respective warp chains with which they are interlaced in order to form the slots, thanks to their decreasing profile towards their free ends, make it possible for the same effect yarns to shrink under the action of said heating means, without however interfering with the tying effect performed by the warp chains, which must not find an oppostion by the effect yarns during their shrinking. In such way, the tying and anchoring of the effect yarns to the textile support by the shurnk stitches of the warp chains is secured.

BRIEF DESCRIPTION OF THE DRAWINGS

The invention is hereunder disclosed in greater detail on the basis of an example of practical embodiment referring to the hereto attached drawings, wherein.

Figure 1:
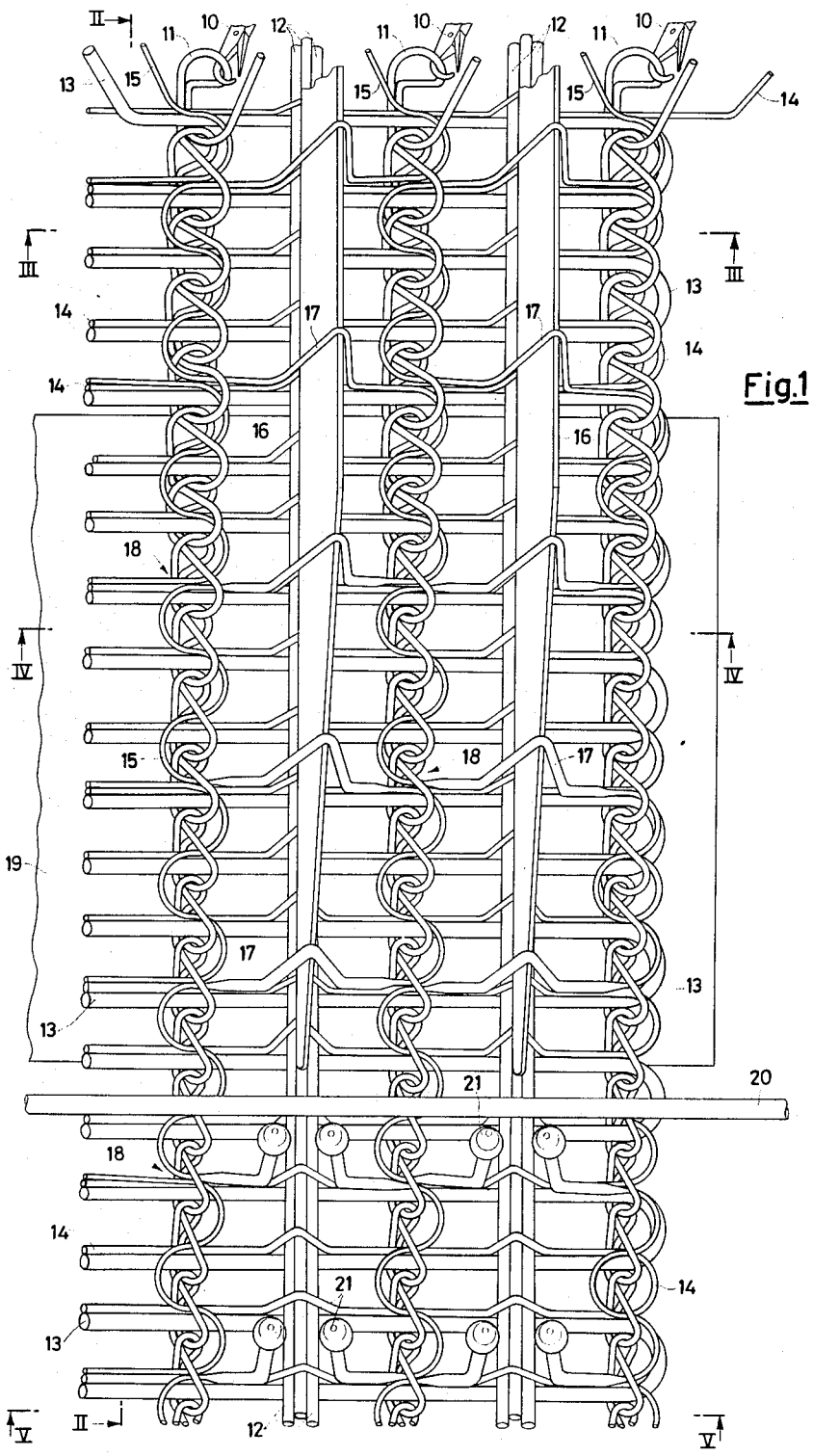
FIG. 1 is a diagram showing a top plan view of an edge portion of the textile manufactured article being formed.

FIGS. from 3 to 5 show trasversal sectional views in the direction of the weft, according to paths III—III, IV—IV and V—V of FIG. 1.

DETAILED DESCRIPTION OF THE PREFERRED EMBODIMENT

In FIG. 1, a top plan diagram is shown of the right-hand edge portion of the textile manufactured article for contact fastener, during its fabrication. In particular, the manufactured article shown is a "male" manufactured article, i.e., it is equipped with hooking, mushroom-shaped articles, protruding from a textile support.

This textile support is manufactured, in the presently shown case, on a "crochet"-type knitting machine, capable of forming a textile manufactured article with warp chains and weft yarns. The knitting machine of this type is per se known, and therefore it is not shown in detail. Only the needles 10 are visible, which form the chains 11 from warp yarns.

In FIG. 1, three from such warp chains 11 are shown, which form a triplet defining two side-by-side couples of chains sharing the central warp chain of the triplet.

The warp chains 11 are linked by a first lower weft yarn 13, to have a constant fabric width: In as much as the crochet machine used in the presently illustrated case has such a fineness (number of needles 10) as to have a certain mutual distance between the warp chains 11, and not to form a continuous fabric, providing filling warp yarns 12 between the warp chains is necessary (in the present case, between each couple of chains 11 three filling yarns are provided). In order to tie the filling yarns 12 with one another, a second upper weft yarn 14 is then provided, which, in cooperation with the lower weft yarn 13, ties said filling yarns 12.

The textile interlacement between the warp chains 11 and the filling yarns 12 with the weft yarns 13 and 14 forms a continuous textile support, of which FIG. 1 shows the right-hand edge portion. Evidently, this textile support can have the desired width which can be accomplished with the crochet machine used for forming it.

Now, in order to realize a textile manufactured article for a contact fastener, inside said textile support effect yarns 15 are interwoven. In particular, between each couple of warp chains, a relevant effect yarn 15 is interlaced in a meander path configuration, and this effect yarn 15 is precisely tied by sequences of at least two, and anyway of an even number of consecutive stitches alternatively belonging to the one, and to the other, of the warp chains 11 of the respective couple of warp chains. In the specific case as shown in FIG. 1, each effect yarn 15 is bound, in the points of tying of the warp chains 11 with the weft yarns 13 and 14, with alternatively four stitches of a warp chain belonging to the relevant couple of warp chains, and with four stitches of the other warp chain belonging to the same couple of warp chains. Simultaneously to the interlacing of the effect yarns 15, said effect yarns 15 are made run, along their lengths between the relevant warp chains 11, around a stationary metal bar, or blade, 16, located between the warp chains 11, so as to form a slot 17.

Figure 2:
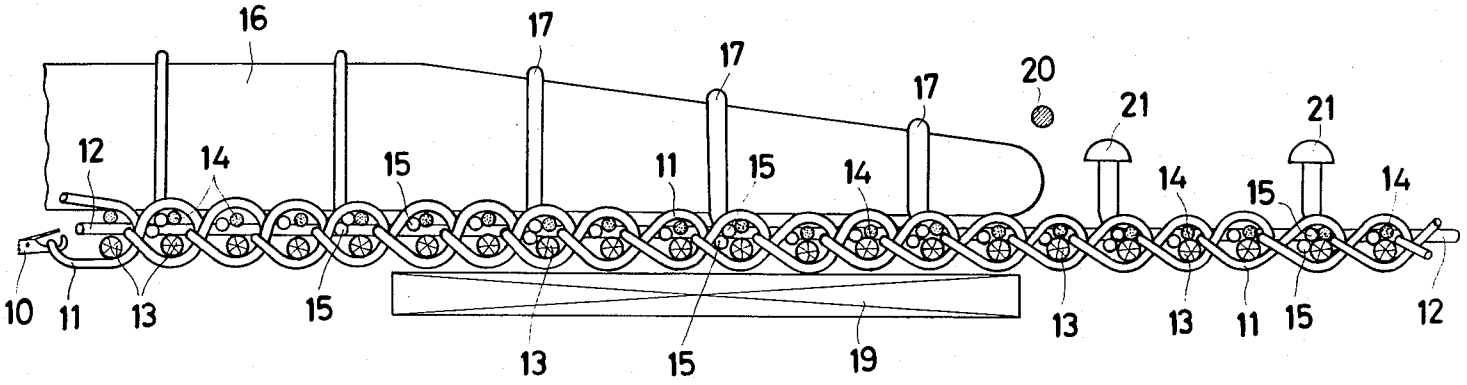
FIG. 2 is a longitudinal sectional view in the direction of the warp along path II—II of FIG. 1.

As it can be seen in FIG. 1, between the warp chains 11, these blades 16 are in fact provided in the warp direction, and on planes perpendicular to the plane of the textile support being formed. For a certain length, these blades 16 have a constant height (see also FIG. 2), whilst along their end length towards their free end, they have a decreasing height, due to the reasons which are better explained in the following.

Each effect yarn 15 is thus interwoven in a meandering path configuration between the respective two warp chains 11, and along its lengths between the warp chains, oriented according to the weft direction, the slots 17 are formed.

It should be reminded that the meander of effect yarn 15 relevant to a couple of warp chains is staggered, in the warp direction, relative to the meander of effect yarn relevant to the side-by-side couple of warp chains through a value equal to the pitch of the meander. Each of the effect yarns 15 extends a substantially similar distance in the warp direction prior to alternating between the corresponding warp chain triplet pairs. Hence, in such tying points as indicated by the reference numeral 18 in FIG. 1, a same stitch of a warp chain ties simultaneously two effect yarns 15 respectively relevant to one couple, and to the side-by-side couple, of warp chains.

It should be specified at this point that the yarns forming the warp chains 11, the filling yarns 12 and the effect yarns 15 are constituted by raw materials having a thermal shrinking coefficient which is considerably larger than of the raw material of the weft yarns 13 and 14. So, e.g., the yarns forming the warp chains 11 and the filling yarns 12 can be of polypropylene, which, when heated from 20° C. up to 120° C., shrinks by approximately 8%, and the weft yarns 13 and 14 can be of a polyester raw material, which, within the same temperature range, shrinks by less than 1%.

As, on the contrary, it relates to the effect yarns 15, if with the same yarns protruding peduncles for a "male" component of a contact fastener have to be generated, as in case of illustrated examples, which have a mushroom shape, said effect yarns can be constituted by a polypropylene monofilament. If, on the contrary, hook-shaped peduncles have to be generated, the effect yarns 15 could be constituted by a polyamide monofilament.

In order to obtain a textile manufactured article of this type, already showing, when leaving the equipment, an already "strong" hand, without having to resort to a spreading of a chemical type, as the lower wweft yarn 13 a monofilament of polyester can be suitably used.

Figure 3:
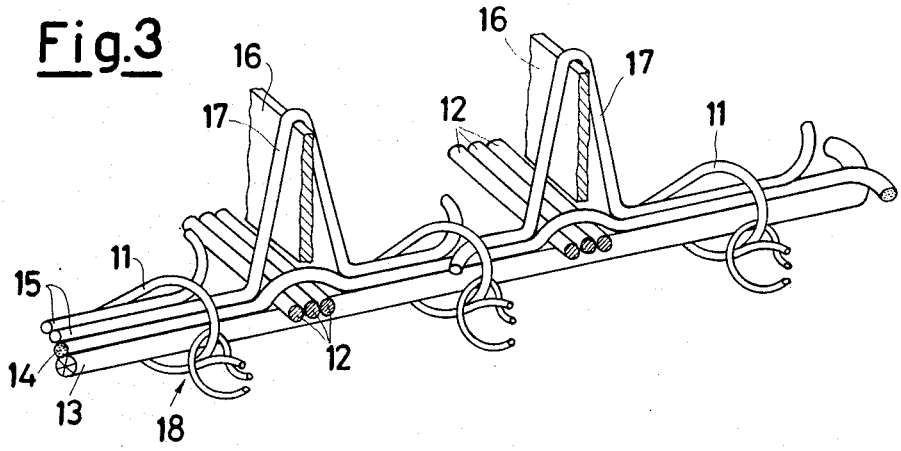
Figure 4:
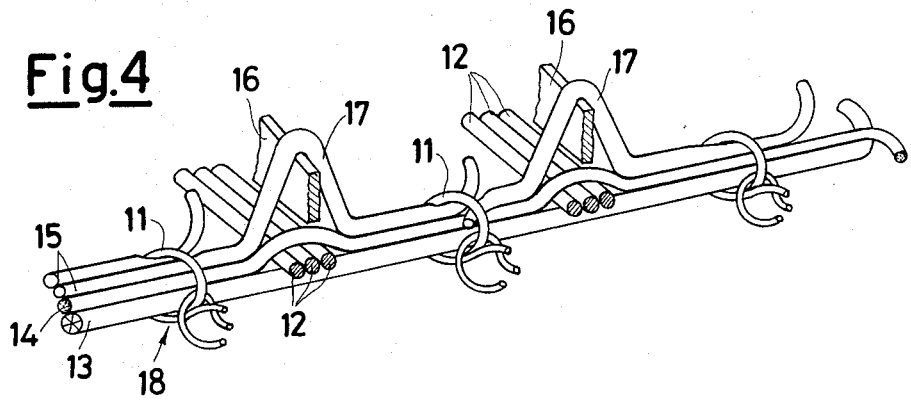
Figure 5:
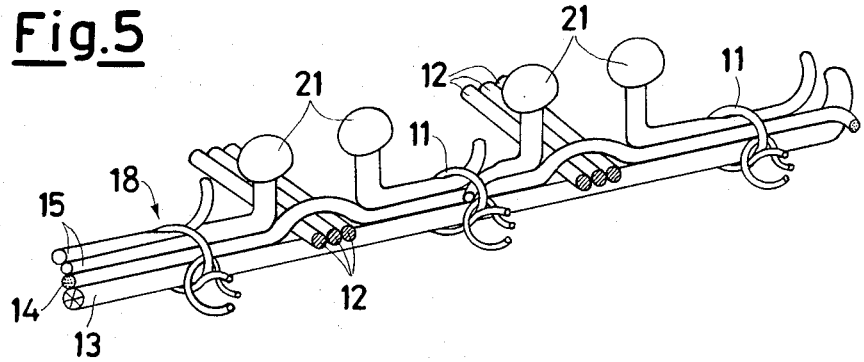

In the area of the equipment which is immediately downstream the formation of the slots 17 along the lengths of the effect yarns 15 between the couples of the warp chains 11, i.e., in an area which extends throughout the whole width of the textile manufactured article, and, in the direction of the warp, substantially throughout the length of the blades 16 along which the same blades have a decreasing height (see FIG. 2), heating means are provided, which can be constituted, e.g., by a temperature-controlled heating plate 19. When the textile manufactured article just formed as above disclosed passes over said heating plate 19, the yarns forming the textile support and the effect yarns behave in different ways under the action of heat. In particular, the yarns forming the warp chains 11 and the filling yarns 12, thanks to the selection of the raw material as above indicated, undergo a thermal shrinking larger than of the weft yarns 13 and 14, so that the stitches of the warp chains 11 block in a very firm way the lengths of effect yarns 15 which are tied and interlaced with them. Also the effect yarns 15 shrink under the action of heat, and this shrinking is allowed, i.e., it is not hindered, thanks to the decreasing profile of the blades 16. Therefore, the shrinking of the effect yarns 15 does not counteract the shrinking of the warp chains 11 and their tying effect. This fact is important in order to obtain a good tying and anchoring of the effect yarns 15 to the textile support. The above mentioned tying effect is clearly visible in the drawings, by comparing the top portion of FIG. 1 to the bottom portion of the same Figure, or the left-hand portion of FIG. 2 to the right-hand portion of same FIG. 2, or, still, FIG. 3 to FIGS. 4 and 5.

Immediately downstream the free end of the blades 16, in case of production of a "male" manufactured article for contact fastener, a device can be provided, which is capable of transforming the slots 17 of the effect yarns 15 into hooking peduncles. In the example of practical embodiment shown in the figures, in as much as the matter is of generating peduncles of mushroom-shaped type 21, a heated wire 20 can be provided, which is taut transversely to the direction of running of the textile manufactured article, which heated wire is lapped by the top portions of the slots 17, when they pass under it, so that same slot top portions are opened by melting, and the mushroom-shaped peduncles 21 are generated.

From the above disclosure, the characteristics of the invention and the advantages which derive from it result clear.

Thanks to the large shrinking of the stitches of the warp chains, a very firm blocking of the effect yarns interwoven with them is obtained, so that a subsequent step of sizing application to the manufactured article can be omitted, without endangering the anchoring of the effect yarns to the textile support. Furthermore, when as the lower weft yarn a monofilament of polyester resin is used, the product is also already endowed with a strong enough hand, without a spreading of chemical type having to be resorted to.

The invention is particularly suitable for accomplishing the "male" portion of a contact fastener, wherein the peduncles are constituted by monofilaments, which are well capable of being firmly blocked onto the textile support by means of the thermal shrinking of the warp chains.

However, the possibility is not excluded that the invention can also be used in order to realize the "female" portion of such a contact fastener.

We claim:

1. Textile manufactured article for a contact fastener, formed by a textile support in which is interwoven at least one effect yarn defining a plurality of hooking elements protruding from one side of the support, characterized in that the textile support is formed by a plurality of warp yarns interlaced in such a way as to form a triplet of warp chains, the warp chains being tied at a plurality of tying points by at least a first weft yarn, the triplet of warp chains defining two side-by-side pairs of warp chains sharing a central warp chain of said triplet, a corresponding effect yarn being interlaced in each of the warp chain pairs in a prescribed path configuration such that each of said effect yarns is tied with an even number of consecutive shrunk stitches alternately formed along each chain of the warp chain pair at said weft yarn tying points, the effect yarns of each of the warp chain triplet extending along said prescribed path a substantially similar distance in the direction of the warp prior to alternating between corresponding warp chains of said warp chain triplet pairs, said warp chains, said effect yarns, and said weft yarn being comprised of yarns, said yarns comprising said warp chains and said effect yarns being constituted by materials having a coefficient of thermal shrinkage which is considerably larger than that of the material constituting said weft yarn.

2. Textile manufactured article according to claim 1, characterized in that a plurality of filling warp yarns are provided between the warp chains, a second weft yarn being provided which, together with said first weft yarn, ties said filling warp yarns with one another, said filling warp yarns being constituted by a material having a thermal shrinkage coefficient larger than that of the material constituting said weft yarns.

3. Textile manufactured article according to claim 1 or 2, characterized in that the lengths of the effect yarns between the warp chair pairs form protruding hooking peduncles, with said effect yarns being constituted by monofilaments of a thermoplastic material.

4. Textile manufactured article according to claim 1 or 2, characterized in that said first weft yarn is constituted by a monofilament.

5. Textile manufactured article according to claim 1 or 2, characterized in that the yarns forming the warp chains and said filling yarns are formed of polypropylene, and that said weft yarns are formed of polyester.

6. Textile manufactured article according to claim 3, characterized in that the effect yarns are constituted by a monofilament of either polypropylene or of polyamide.

7. A textile manufactured article according to either claim 1 or 2, characterized in that said even number of consecutive shrunk stitches is two.

* * * * *